United States Patent [19]

Okabe et al.

[11] 4,314,803

[45] Feb. 9, 1982

[54] TANNING METHOD

[75] Inventors: Tohru Okabe, Hyogo; Shigeaki Mizutani, Himeji; Saburo Hayashi, Kakogawa, all of Japan

[73] Assignee: Seitetsu Kagaku Co., Ltd., Japan

[21] Appl. No.: 187,857

[22] PCT Filed: Feb. 21, 1979

[86] PCT No.: PCT/JP79/00041

§ 371 Date: Oct. 23, 1979

§ 102(e) Date: Oct. 17, 1979

[87] PCT Pub. No.: WO79/00712

PCT Pub. Date: Oct. 4, 1979

[30] Foreign Application Priority Data

Feb. 23, 1978 [JP] Japan ..... 53-20517
Jan. 22, 1979 [JP] Japan ..... 54-6763

[51] Int. Cl.[3] ..... C14C 3/06

[52] U.S. Cl. ..... 8/94.26; 8/94.18; 8/94.27

[58] Field of Search ..... 8/94.18, 94.27, 94.26

[56] References Cited

FOREIGN PATENT DOCUMENTS 244550 10/1969 U.S.S.R. ..... 8/94.27
271704 9/1970 U.S.S.R. ..... 8/94.18
308065 8/1971 U.S.S.R. ..... 8/94.26

*Primary Examiner*—Maria Parrish Tungol
*Attorney, Agent, or Firm*—Pollock, Vande Sande & Priddy

[57] ABSTRACT

By subjecting a hide which has completed beamhouse work to a pickling treatment in the presence of urotropin (hexamethylenetetramine) and then to a chrome-tanning treatment, pH control of chrome-tanning bath becomes simpler and easier, the combination between hide and basic chrome complex increases, and the amount of residual chromium in the waste water can be minimized. Further, by treating the formed leather which has completed tanning treatment with ammonia or ammonium salt of weak acid in the chrome bath after use, the workability in the finishing steps improves, quality of the leather additionally improves, and the chromium content of the residual solution can be made nearly zero.

13 Claims, No Drawings

TANNING METHOD

TECHNICAL FIELD

This invention relates to a tanning process, and more particularly to the improvement of chrometanning process.

BACKGROUND ART

As is well known, chrome-tanning process is a process for converting a hide to a leather by subjecting a raw hide to the so-called beamhouse works such as washing with water, soaking, liming, unhairing, deliming, bating etc. to obtain a green hide which has been prepared in accordance with the kind of the intended leather product, followed by pickling it and letting a chromium salt act upon it.

In the usual chrome-tanning process, a hide after the pickling step is treated in a tanning bath containing a basic chrome complex. In this case, the chrome complex is used in an amount of 2.0–2.5 parts by weight (hereinafter simply referred to as "part(s)") as $Cr_2O_3$ per 100 parts of hide, and the tanning is made progress by adjusting pH of the bath to about 3.0 at the beginning, frequently adding a small quantity of alkali such as sodium bicarbonate and thereby adjusting pH to 3.5–4.0 at the end of tanning.

Control of pH of the bath is important, and basicity of chrome salt increases with elevation of pH. At the same time, chrome salt becomes easier to combine with hide. However, if pH is elevated too rapidly, the chrome salt becomes easy to combine with the surface of hide so that an incompletely tanned leather is given. In an extreme case, chromium hydroxide precipitates to make the tanning impossible. Even if it does not occur, olation of chrome salt takes place to form a colloid so that a leather of low quality is given. On the other hand, if tanning progresses at a low pH value, the leather formed is low in the quantity of combined chromium, slender, hard and inferior in quality. As above, the control of pH of bath is quite important for obtaining a leather of good quality by the combination of hide and chrome salt in the tanning bath.

The concentration of chrome salt in tanning bath is also important. In general, as the concentration decreases, the increase in basicity due to elevation of pH becomes remarkable and control of pH becomes more difficult. For example, a high basicity chrome salt having a basicity of 60% is stable in a bath of $Cr_2O_3$ 50 g/liter, but if this bath is diluted 10 times the basicity of the chrome salt increases to form a precipitate.

Thus, chrome tanning is carried out while elevating the basicity of tanning bath, having a chrome salt concentration of 15–50 g/liter as $Cr_2O_3$, from about 30 to about 50. However, chromium in the bath is not always combined to the hide exhaustively but the residual bath after the completion of tanning usually contains 30–50% of the chromium used as uncombined chromium. For the sake of preventing public hazard, the residual liquid is usually subjected to a chemical treatment for removing or recovering the existing chromium, after which it is discharged.

As compared with vegetable tanned leather, chrome-leather is characterized in that it is rich in heat resistance, flexibility and elasticity. On the other hand, its chromium bond is released and it is swollen by an organic acid or an alkali solution, which is regarded as its disadvantage.

DISCLOSURE OF INVENTION

It is an object of this invention to provide a chrome tanning method by which the major part of chrome salt in tanning solution can be fixed in hide and the chrome salt content in the waste water can be minimized.

It is another object of this invention to provide a chrome tanning method by which frequent addition of basicity controller is made unnecessary for controlling pH of the chrome tanning solution to about 3 of the beginning stage to about 4 of the final stage.

It is further another object of this invention to provide a chrome tanning method which gives a chrome-tanned leather more resistant to organic acids and alkalis than usual ones.

According to this invention, there is provided a chrome tanning method characterized by pickling a hide which has completed the beamhouse works in the presence of urotropin followed by subjecting it to a chrome tanning treatment.

BEST MODE FOR CARRYING OUT THE INVENTION

In the method of this invention, the beamhouse works for chrome tanning may be carried out in the usual way. The pickling step may be in the usual way except that urotropin (hexamethylenetetramine) is added to the pickling solution. Preferably, however, it is practised in the following manner, wherein parts are by weight.

100 parts of a weakly alkaline hide subjected to beamhouse works is introduced into a rotating wooden drum together with 20–100 parts of water, 6–10 parts of sodium chloride or sodium sulfate and 0.6–1.2 parts of sulfuric acid or sulfuric acid-formic acid mixture. While rotating the drum, pH of the hide is brought about to 2–3. Then, 0.2–10 parts of urotropin is added and the drum is rotated for 2–3 hours to allow the urotropin permeate into the hide. If necessary, an additional quantity of dilute sulfuric acid is slowly added until molar ratio of urotropin to sulfuric acid comes to 0.5–1.0, after which the drum is rotated for an additional 3–5 hours. Then the rotation is stopped and the mixture is allowed to stand overnight as it is.

Herein, though the time of adding urotropin is not particularly limited, it is preferably added after the hide and the acid have come into contact in the presence of neutral salt as has been mentioned above. If the amount of urotropin added exceeds the upper limit of the above-mentioned range, the effect cannot be improved particularly. If the amount is less than the lower limit, the effect is insufficient. In the range mentioned above, a preferable amount of urotropin added is 1–5 parts per 100 parts of hide.

The effect of pickling in the method of this invention can be more improved by elevating the temperature of pickling bath in the presence of urotropin. Thus, if pickling treatment is carried out for 10–30 hours while regulating the temperature of pickling bath to 15°–40° C. and preferably to 25°–30° C. and then tanning is carried out in a tanning bath which has been prepared by adding an appropriate quantity of chrome tanning agent to the same pickling bath as above, pH of the bath automatically rises to an appropriate value without adding any alkaline material and tanning can be practised smoothly.

After completion of pickling treatment, the hide is subjected to a tanning work in a tanning bath which has been prepared by adding a chrome tanning agent to the same pickling solution. As chrome tanning agent, various kinds of products are developed and commercialized. They usually contain chromium in an amount of 21–26% as $Cr_2O_3$, and their main component is basic chrome complex of which basicity ranges from 33% to 67%. As commercial products, Chromdol (commercialized by Kawamata Kagaku Kogyo Co.), Neochrome (commercialized by Nippon Kagaku Kogyo Co.), Beachrome (commercialized by Nippon Denko Co.), Chromosal, Baychrom (commercialized by Bayer Co.), Chromitan (commercialized by BASF Co.) and the like can be referred to, which are all usable in this invention. Home-made tanning solutions of concentrated chrome complex salt produced by reducing a sixvalent chromium compound such as sodium bichromate or the like with an organic reducing compound such as glucose or the like can also be used.

The amount of chrome tanning agent used is 0.0025–1.5 parts as $Cr_2O_3$ per 100 parts of hide, which is smaller than that in the usual chrome tanning. In this invention the major part of chromium in the bath combines with hide, so that its amount used may be smaller than in the usual method.

The tanning may be carried out by the usual work using a rotating wooden drum. Although an auxiliary use of pH controller such as sodium bicarbonate is sometimes necessary for the control of pH depending on the quantitative ratio between basic chrome salt and urotropin used, the frequency of the addition of pH controller may be far smaller than in conventional methods. When the quantitative ratio is appropriate, tanning can be practised only by rotating the drum without any aid of pH controller. Though the appropriate quantitative ratio varies with basicity of chrome salt, intended kind of leather, etc., the ratio $Cr_2O_3$: urotropin is in the range of 1:1.5 to 1:5 by weight. Throughout the tanning time of 5–15 hours, pH gradually increases until it reaches the final pH of about 4.0 where the tanning is completed. The time necessary for tanning is shortened by elevating bath temperature, and the bath temperature is in the range of 15°–40° C. The leather formed is taken out of the drum and aged at room temperature for 2–3 days, whereby the tanning of this invention is completed.

Since amounts of the above-mentioned materials, pH value of bath and time period of treatment have to be varied depending on the kind of hide, the methods of treatments such as soaking, unhairing, deliming, bating etc. and the atmospheric temperature, they may be determined appropriately.

According to the tanning method of this invention, the major part of the chromium in the chrome tanning agent added is consumed by combination with hide, so that the amount of residual chrome in chrome tanning solution can be decreased to 0.8–24% of the amount added in the method of this invention, whereas it is 30–50% in the case of usual chrome tanning. The method of this invention is also superior to a prior chrome tanning method which comprises adding formalin at the time of pickling and then practising the usual chrome tanning in the following points:

1. Addition of basicity controller is not always necessary to the pH control after addition of chrome tanning agent.

2. The temperature of shrinkage in liquid of hide rises more speedy and shows a higher value at the same amount of chrome tanning agent added.

3. The quantity of $Cr_2O_3$ remaining in the solution after completion of the reaction is quite small at the same amount of chrome tanning agent added.

In other words, as compared with the method of this invention, prior methods have the following faults though the amount of chrome tanning agent added is the same:

(1) The rise of the temperature of shrinkage is slow and the temperature of shrinkage itself is low, so that the product is inferior in practical value as a shoe leather.

(2) Since pH drops in the course of tanning, a basicity controller has to be added frequently and in small portions so as to maintain the pH range allowing a smooth tanning.

(3) A large amount of $Cr_2O_3$ remains in the solution after completion of the reaction. (In order to elevate the temperature of shrinkage, the amount of chrome tanning agent has to be increased, which results in an extreme increase of $Cr_2O_3$ concentration in the solution after completion of the reaction.)

The leather obtained by the method of this invention has the following characteristic features. Thus, it has a color shade of white or light greenish blue and the color becomes faint upon drying, so that a clear color is obtained after dyeing. The temperature of shrinkage in liquid is 105°–115° C., which means its comparableness to usual chrome-tanned leathers in heat resistance. As compared with the usual chrome-tanned leathers, it is entirely free from the phenomenon of swelling in the presence of alkalis and organic acids, which demonstrates its excellency in resistance to acid and alkali. On the other hand, it has a finegrained appearance of the grain, and it has also been found to be excellent in flexibility and elasticity. It is also an effect of this invention that the interlayer distribution of chrome in leather is uniform so that a leather of uniform quality is obtained.

Even in the above-mentioned method of this invention, it is still impossible to make the chrome content remaining in the tanning bath after use completely zero. Also, urotropin yields various intermediate products probably in the process of its decomposition and reaction with hide, which exists in the bath solution in an unstable form and resides in the bath solution after completion of tanning, so that it can sometimes emit a disagreeable odor in the subsequent steps to incur a hygienic problem.

Another characteristic feature of this invention consists in overcoming the above-mentioned fault by treating, after completion of tanning, the resulting leather with ammonia or ammonium salt of weak acid in the residual tanning bath. By this treatment, the amount of residual chromium in the residual bath can be decreased markedly to nearly zero. Although the mechanism of the treatment and the structures of intermediates are unknown, it is rather unexpected that the above-mentioned effect can easily be obtained and a leather of high quality can be produced merely by adding a simple compound such as ammonia or ammonium salt of weak acid to the drum after completion of tanning and rotating it, so that this invention has a great industrial value. Though the ammonia may be blown in a gaseous form, usually it is employed in the form of an aqueous solution.

As said ammonium salt of weak acid, acidic ammonium carbonate, ammonium formate or ammonium oxalate is employed usually. It is also allowable to use them in combination with ammonia. In order to obtain good results, they are added in an amount of 0.01–10 parts and preferably 0.1–3 parts, as $NH_3$, per 100 parts of hide. At this time, pH of the bath is 5–6, preferably. If the amount of ammonia and/or ammonium salt of weak acid is too small, the effect of removing the intermediates is insufficient.

If it is too large, it is uneconomical and the pH rises and quality of leather drops.

This invention will be illustrated concretely by the following non-limitative examples and comparative examples.

In the examples and comparative examples, parts denotes parts by weight per 100 parts by weight of hide.

EXAMPLE 1

60 sheets of steer hide produced in North America were unhaired, delimed, bated and then washed with water by using 200 parts of water per 100 parts of the hide. After draining, the hide weighed 780 kg. The drained hide was introduced into a rotating wooden drum having a diameter of 2 m and a rotating speed of 10 r.p.m., 20 parts of water and 6 parts of sodium chloride were added thereto and the drum was rotated for 10 minutes. Then, a mixture of 1.8 parts of sulfuric acid and 18 parts of water was added and the drum was rotated for 10 minutes. Then, 1.8 parts of urotropin was added and the drum was rotated for 4 hours. Then rotation was stopped and the drum was allowed to stand overnight. Next morning, the drum was rotated for 30 minutes, after which 3 parts of a powdery chrome tanning agent having a $Cr_2O_3$ content of 25% and a basicity of 33% (Beachrome-S, manufactured by Nihon Denko Co.) were added thereinto and the rotation was continued. The pH of the tanning bath changed in such a manner that it was 3.15 after 1 hour, 3.49 after 4 hours and 3.75 after 7 hours. After 7 hours, rotation of the drum was stopped and the drum was allowed to stand overnight, whereby the tanning was completed. At this time, the pH was 3.73. Concentration of chromium in the bath was 0.06 g (as $Cr_2O_3$)/100 g of hide.

Subsequently, while rotating the drum, an aqueous solution comprising 2.6 parts of acidic ammonium carbonate and 15 parts of water was added in three equal portions at time intervals of 60 minutes and then the rotation was continued for an additional 30 minutes. As a result, the pH of the solution was 5.5 and its chromium content was 0.0005 g (as $Cr_2O_3$)/100 g of hide. At this time, the leather and the solution had entirely lost their disagreeable odors. The leather was taken out of the bath and left standing at room temperature for 2 days for the sake of aging.

The temperature of shrinkage in liquid of the tanned leather thus obtained was 113° C., which was hardly different from that of usual tanned leathers.

Qualities of the leather obtained are shown in Table 1.

A finished leather obtained by subjecting the leather thus formed to finishing steps such as dyeing, fatliquoring, etc. in the usual way was not different from usual chrome-tanned leathers in appearance and physical strengths, except that it was superior to the latter in the clarity of color.

EXAMPLE 2

A tanning process was completed by repeating the procedures of Example 1, except that the tanning bath of Example 1 was prepared according to the following recipe: 6.2 parts of sulfuric acid, 62 parts of water, 8 parts of urotropin and 0.05 part of powdery tanning agent. The bath after use had a $Cr_2O_3$ content of 0.0001 g/100 g of hide. Subsequently, a solution obtained by diluting 7.76 parts of 25% ammonia water with 15 parts of water was added in three equal portions at time intervals of 60 minutes, after which the rotation was continued for an additional 30 minutes. As a result, the pH of the solution became 5.3, and the leather and solution became entirely free from disagreeable odor.

The leather was taken out of the solution and left standing for 2 days for the sake of aging. The temperature of shrinkage in liquid of the tanned leather thus obtained was 109° C. As compared with usual chrome tanned leathers, no difference was recognizable in its appearance and physical strengths. Concentration of $Cr_2O_3$ in the final waste water was below the limit of detection.

Qualities of the leather obtained are shown in Table 1.

EXAMPLE 3

A tanning process was completed by repeating the procedures of Example 1, except that the tanning bath of Example 1 was prepared according to the following recipe: 0.8 part of sulfuric acid, 8 parts of water, 0.5 part of urotropin and 3.3 parts of powdery chrome tanning agent, and the pH was maintained in the same manner as in Example 1 by portionwise adding 2.2 parts of acidic sodium carbonate. The pH of the residual bath was 3.6, the temperature of shrinkage in liquid of the leather was 105° C., and the content of $Cr_2O_3$ in the solution was 0.2 g/100 g of hide.

Subsequently, while rotating the drum, a solution obtained by dissolving 0.37 part of ammonium formate in 3.7 parts of water was added in three equal portions at time intervals of 60 minutes, after which the rotation was continued for an additional 30 minutes. As a result, the pH of the solution became 6.0 and its $Cr_2O_3$ content became 0.0007 g/100 g of hide. At this time, the leather and the solution were entirely free from disagreeable odor.

This tanned leather was finished in the same manner as in Example 1 to give a finished leather. It had a temperature of shrinkage in liquid of 110° C. As compared with usual chrome tanned leathers, no difference was recognizable in appearance and physical strengths.

Qualities of the leather obtained are shown in Table 1.

EXAMPLE 4

100 parts of chopped kip hide, after being unhaired, delimed and bated, were introduced into a wooden drum together with 100 parts of water and 7 parts of sodium sulfate, and the drum was rotated for 10 minutes. Then, a solution obtained by dissolving 0.9 part of sulfuric acid and 0.4 part of formic acid into 10 parts of water was added, the drum was rotated for 2 hours at a bath temperature of 10° C., and it was left standing overnight. The pH of the bath was 2.01 after the drum had been rotated for 30 minutes, which rose to 3.22 after the overnight dipping, when the hide had a temperature of shrinkage in liquid of 46° C.

Then, urotropin was added in an amount of 4 parts per 100 parts of hide and the drum was rotated for 3 hours. Then, 10% sulfuric acid was added until molar ratio urotropin/sulfuric acid reached 1.0 over a time period of 20 minutes and rotation of the drum was continued for 3 hours, after which the rotation was stopped and the hide was dipped overnight.

Then, 3 parts of a powdery chrome tanning agent (commercial name: Neochrome, basicity 33%, $Cr_2O_3$ content 25%, manufactured by Nihon Kagaku K.K.) were added and the drum was rotated for 5 hours. Then, 2 parts of acidic sodium carbonate were added as a 5% aqueous solution and the drum was rotated for 5 hours. As a result, the pH of the bath was 4.92 and temperature of shrinkage in liquid of the leather was 105° C. The leather was taken out of the drum and aged at room temperature for 2 days.

Qualities of the leather obtained are shown in Table 1.

Comparative Example 1

100 parts of steer hide produced in North America, which had been unhaired, delimed and bated according to the usual method, were introduced into a drum together with 20 parts of water and 6 parts of sodium chloride as a neutral salt and the drum was rotated for 10 minutes. Then, a solution obtained by dissolving 1.2 parts of sulfuric acid into 12 parts of water was added and, without adding any urotropin, the drum was rotated for 4 hours, after which the hide was dipped overnight. The pH of the bath was found to be 1.2 at the time when the sulfuric acid was added, while it was 2.7 after 3 hours and 3 after the overnight dipping. On the other hand, the temperature of shrinkage in liquid of the hide was 35° C., 36° C. and 32° C. at the same times as above.

Then, 3 parts of the same powdery chrome tanning agent as used in Example 1 were added and the drum was rotated for 7.5 hours while maintaining pH in the same range as in Example 1 by adding 0.95 part of acidic sodium carbonate, after which it was left standing overnight. Subsequently, aging was carried out in the same manner as in Example 1.

Qualities etc. of the leather obtained are shown in Table 1.

Comparative Example 2

The procedure of Example 4 was repeated, except that the urotropin and the 10% sulfuric acid were not added and the chrome tanning agent was added in an amount of 8 parts.

Qualities of the leather obtained are shown in Table 1.

Comparative Example 3

100 parts of steer hide produced in North America, which had been subjected to unhairing, deliming and bating 20 parts of water and 6 parts of sodium chloride were introduced into a drum and rotated for 10 minutes. Then, a solution obtained by dissolving 1.0 part of sulfuric acid into 10 parts of water was added and the drum was rotated for 15 minutes.

Then, in place of urotropin, 1.29 parts of formaldehyde was added in the form of 35% aqueous solution, the drum was rotated for 4 hours, and then it was left standing overnight. The pH of the bath was 1.9 at the time when the formaldehyde was added, while it was 3.1 after the overnight dipping. On the other hand, the temperature of shrinkage in liquid of the hide was 39° C., 49° C. and 68° C. at the same times as above.

Then, 3 parts of the same powdery chrome agent as used in Example 1 were added and the drum was rotated for 7.5 hours while maintaining pH at 3–4 by adding 1.24 parts of acidic sodium carbonate. Subsequently, it was left standing overnight for the sake of aging in the same manner as in Example 1.

Qualities of the leather obtained are shown in Table 1.

Comparative Example 4

100 parts of an unhaired, delimed and bated steer hide produced in North America, 20 parts of water and 6 parts of sodium chloride were introduced into a wooden drum and rotated for 10 minutes. Then, a mixture of 1 part of sulfuric acid and 10 parts of water was introduced thereinto and the drum was rotated for 5 minutes. Then, 1.29 parts of formaldehyde were added in the form of 35% aqueous solution and the drum was rotated for 4 hours, after which it was left standing overnight.

Then, 3 parts of the same powdery chrome tanning agent as in Example 1 were added and the drum was rotated for 7.5 hours while maintaining pH at 3.0–3.5 in the same manner as in Example 1 by adding 1.24 parts of acidic sodium carbonate, after which it was left standing overnight. At this time, the pH was 3.6 and the concentration of $Cr_2O_3$ in solution was 0.13 g/100 g of hide. Subsequently, while rotating the drum, 1.96 parts of ammonia were added as 25% ammonia water in equal three portions at time intervals of 60 minutes and then the drum was rotated for an additional 30 minutes. As the result, the pH of the solution became 8.0 and the solution and the leather became free from disagreeable odor. However, the chromium in the solution precipitated as chromium hydroxide at the time of the first addition of ammonia water. Also, as a result, chromium hydroxide deposited on the surface of leather to form unevenness. In addition, physical properties of the leather were so deteriorated that the leather was unusable practically.

The results obtained are shown in Table 1.

TABLE 1

| | Item | | | | | |
|---|---|---|---|---|---|---|
| | | | | Degree of swelling (20° C., 24 hrs) | | |
| Example No. | Temperature of shrinkage in liquid (°C.) | Weight of $Cr_2O_3$ in leather (%) | Maximum concentration difference in the interlayer distribution of $Cr_2O_3$ in leather ($Cr_2O_3$%) | 10% Sodium hydroxide | 50% Acetic acid | Chromium in wastewater ($Cr_2O_3$g/100 g hide) |
| Example 1 | 113 | 2.55 | 0.2 | 1.0 | 1.0 | 0.0005 |
| 2 | 109 | 0.04 | 0.2 | 1.4 | 1.5 | Undetectable |
| 3 | 110 | 2.5 | 0.3 | 1.0 | 1.0 | 0.0007 |
| 4 | 109 | 2.2 | 0.2 | 1.0 | 1.0 | 0.105 |
| Comparative Example 1 | 79 | 2.41 | 0.8 | 3.0 | 2.5 | 0.10 |
| 2 | 108 | 4.2 | 0.8 | 1.8 | 2.1 | 0.775 |
| 3 | 98 | 2.4 | 0.9 | 1.3 | 1.5 | 0.13 |
| 4 | 96 | 2.45 | 1.1 | 1.7 | 1.6 | Preciti- |

TABLE 1-continued

| Example No. | Temperature of shrinkage in liquid (°C.) | Weight of $Cr_2O_3$ in leather (%) | Maximum concentration difference in the inter-layer distribution of $Cr_2O_3$ in leather ($Cr_2O_3$%) | Degree of swelling (20° C., 24 hrs) 10% Sodium hydroxide | 50% Acetic acid | Chromium in waste-water ($Cr_2O_3$g/100 g hide) |
|---|---|---|---|---|---|---|
| | | | | | | tation |

INDUSTRIAL APPLICABILITY

This invention facilitates the chrome tanning process in the leather industry and enables to obtain a chrome leather of good quality and to minimize the chromium content of chrome tanning waste water. Therefore, it is believed to have a great applicability.

We claim:

1. A chrome-tanning method comprising subjecting a hide which has completed beamhouse work to a pickling treatment in the presence of hexamethylenetetramine wherein the pickling composition consists essentially of acid, neutral salt and water; and then subjecting the hide to a chrome-tanning.

2. A method according to claim 1, wherein the amount of hexamethylenetetramine is 0.2–10 parts by weight per 100 parts by weight of the hide.

3. A method according to claim 1, wherein said hexamethylenetetramine is added at the later stage of the pickling treatment after the hide has contacted the pickling composition.

4. A method according to claim 1, wherein said hexamethylenetetramine is used at a ratio of 1.5–5 based on the weight of $Cr_2O_3$ in the basic chromium salt used for chrome-tanning treatment.

5. A method according to claim 1, wherein the basicity of the basic chromium salt used for chrometanning treatment is about 30–36%.

6. A method according to claim 1, wherein the amount of the basic chromium salt used for chrometanning treatment is 0.0025–1.5 parts by weight as $Cr_2O_3$ per 100 parts by weight of the hide.

7. A method according to claim 1, wherein said pickling treatment is carried out at 15°–40° C.

8. A chrome-tanning method comprising subjecting a hide which has completed beamhouse work to a pickling treatment in the presence of hexamethylenetetramine and then to a chrome-tanning treatment, followed by treating it with ammonia or ammonium salt of weak acid in the residual tanning solution after use.

9. A method according to claim 8, wherein said ammonium salt of weak acid is acidic ammonium carbonate, ammonium formate or ammonium oxalate.

10. A method according to claim 8, wherein the amount of ammonia or ammonium salt of weak acid used is an amount enough to make a pH of 5–6 of the residual tanning solution after use 5–6.

11. A method according to claim 8, wherein the amount of ammonium salt of weak acid used is 0.01–10 parts by weight per 100 parts by weight of the hide.

12. A method according to claim 8, wherein the amount of ammonium salt of weak acid used is 0.1–3 parts by weight per 100 parts by weight of the hide.

13. The method of claim 8 wherein the pickling composition consists essentially of acid, neutral salt and water.

* * * * *